United States Patent [19]

Dial et al.

[11] Patent Number: 4,775,948

[45] Date of Patent: Oct. 4, 1988

[54] BASEBALL HAVING INHERENT SPEED-MEASURING CAPABILITIES

[75] Inventors: Dwain Dial, Elk Grove Village, Ill.; Hong T. Lin, Jr., Taipei, Taiwan; Michael Yang, Chang Hwa, Taiwan; Ding-Li Huang, Taipei Hsien, Taiwan; Teng C. Lu, Taipei, Taiwan

[73] Assignee: Monogram Models, Inc., Morton Grove, Ill.

[21] Appl. No.: 1,787

[22] Filed: Jan. 8, 1987

[51] Int. Cl.[4] ..... G06F 15/20; A63B 69/36

[52] U.S. Cl. ..... 364/565; 273/58 G; 273/183 C; 368/250; 368/255; 377/5

[58] Field of Search ..... 377/5; 368/2, 250, 255, 368/278; 33/506; 273/25, 58 G, 26 R, 183 C, 213; 364/410, 565

[56] References Cited

U.S. PATENT DOCUMENTS 4,166,976 9/1979 Ruhnall et al. ..... 364/565

FOREIGN PATENT DOCUMENTS 0086739 8/1983 European Pat. Off. ..... 368/255

OTHER PUBLICATIONS

Potpourri, Autumn (Sep.) 1987, "Computes Speed of Pitched Ball", p. 93.

*Primary Examiner*—Parshotam S. Lall
*Assistant Examiner*—Kevin J. Teska
*Attorney, Agent, or Firm*—Milton S. Gerstein; Marvin N. Benn

[57] ABSTRACT

A baseball with a self-contained speed-measuring module positioned within a hollowed-out portion of the solid core of the ball, with the upper portion of the module being a display unit that indicates the speed at which the baseball was thrown over a fixed distance, the read-out of the display unit being visible from the outside to allow for the reading thereof. The module is enclosed in a single, unitary housing, and includes a computer chip. The chip includes speed-determining circuitry, and is made up of a programmable counter that counts down a plurality of times for every time interval of the flight of the thrown ball, the value representative of each time interval being loaded into the programmable counter by a programmable logic array, whose inputs are coupled to the outputs of a most-significant digit display counter of an LCD unit, the instantaneous value of which is representative of the time interval determined by the countdown rate of the programmable counter. Each time interval represents a portion of a graph of speed vs. time, with ten points in each time interval being approximated by a first-order linear approximation, with each of the ten points representing one countdown of the programmable counter. A piezoelectric stop switch is provided for stopping the counter and latching the data to indicate the speed of the thrown ball.

23 Claims, 6 Drawing Sheets

BASEBALL HAVING INHERENT SPEED-MEASURING CAPABILITIES

BACKGROUND OF THE INVENTION

The present invention is directed to a baseball having the capability of measuring how fast the baseball is pitched over a certain distance. It is, of course, desirable for a baseball pitcher to determine how fast he has thrown the ball, which is conventionally accomplished by using a radar gun positioned behind the catcher to whom the pitcher throws the baseball. The radar gun measures the speed by utilizing the well-known Doppler effect, which is caused by a shift in the wavelength. There are baseballs that measure the elapsed time from the moment the baseball leaves the pitcher's hand to the moment it is caught by the catcher. Such prior-art baseballs typically include a "start" switch which initializes the timer, and a "stop" switch for sensing the impact of the baseball, when it is caught, so as to terminate the timer. A chart utilizing the elapsed time may then be used to look up the speed at which the ball was thrown. The stop-sensing switch is typically an inertia switch, which is basically a spring establishing a movable contact at one end. These inertia switches generally perform well, but have a deficiency in that, if the ball is caught directly along the longitudinally axial line of the spring, the sensing switch does not operate to stop the timer. Further, such prior-art baseballs (that measure the elapsed time of the thrown ball) include a number of parts not enclosed within a general housing and, therefore, subject all the parts to extreme vibrations, excessive pressures and strains, and wear and tear without the parts working together to cushion the shocks. In addition, the prior-art baseball with timer necessitates the time-consuming process of looking up the indicated time on a chart to determine the speed.

SUMMARY OF THE INVENTION

It is, therefore, the primary objective of the present invention to provide a baseball with an inherent speed-indicating device that indicates, on the face of the ball, the speed at which it was thrown, without the further necessity of looking up the speed on a chart or the like.

It is also an objective of the present invention to provide such a baseball with a speed-indicating unit that is encapsulated in one, unitary housing, and which provides a holistic effect to give the unit greater shock-absorbing abilities in order to achieve a more durable and accurate device.

It is yet another objective of the present invention to determine the speed at which the baseball was thrown by the use of a high-speed electronic device, without the need of using a microprocessor with associated memory.

It is still another objective of the present invention to provide the speed-determining unit of the invention with a stop-sensing switch of the piezoelectric type, in order to provide a longer lasting and better performing device.

Toward these and other ends, the baseball of the present invention is provided with an integral, unitarily-housed, speed-determining unit or module, which is radially mounted in a hollow cutout formed in the core of the ball, such that one end of the unit is substantially flush with the outer circumferential surface of the baseball core, with the other end thereof extending radially inward toward the center of the baseball's core. One, integral housing unit mounts the speed-measuring unit, which unit provides greater shock-absorbing qualities in order to produce a longer-lasting device. The speed-determining device itself incorporates a piezoelectric switch, embodied in the form of a plate, connected by a pair of springs to the device's computer chip. Each of the springs is provided with a first and second end, operatively connected between the piezoelectric plate and a pad on the hybrid board mounting the computer chip. Each of the ends of the pair of springs is free from bonding or soldering to the respective parts with which it is connected in order to increase the lifespan thereof, and to help better absorb the shocks associated with the sudden deceleration and stopping of the baseball as it is caught by the catcher. The unit also incorporates padding to additionally aid in its shock-absorbing qualities.

The operating principle behind determining the speed at which the baseball is thrown is based on a selection of nine time intervals along a curve which plots speed against time (the distance thereof being fixed), with the points between each true point on the curve, indicating the time of the nine time intervals, being approximated by a first-order linear approach, the linear approach approximating ten points along the curved path between adjacent true end points of each time interval.

A start switch is coupled to the operating circuitry to initialize the components thereof and to display an initial figure on the liquid crystal display (LCD). Upon release of the start switch, the operating circuitry is activated for counting down and continually determining, during its flight, the speed at which the ball is thrown. When the ball is caught, the piezoelectric stop switch causes the operating circuitry to be latched at the speed indicating the time the baseball was caught, the countdown having been initiated by the release of the baseball from the pitcher's hand. The operating circuitry includes a first delay-timer for measuring the first time interval t1, after which time the operating circuitry's programmable counter, or variable rate timer, is activated for counting down the time interval t2. The programmable counter is continually reloaded by a programmable logic array (PLA), with the value loaded into the programmable counter determined by the status of the most-significant digit display counter of the LCD unit. The programmable counter counts down a plurality of times, with the countdown of each being representative of a respective time interval, as controlled by the PLA therefor, which PLA causes a value representative of the present reading of the LCD unit's display counter to be reloaded into the programmable counter. A halt signal is entered into the variable programmable counter via the piezoelectric switch, which thereby freezes the display counter to indicate the speed at which the ball was thrown.

BRIEF DESCRIPTION OF THE DRAWINGS

The invention will be more readily understood with reference to the accompanying drawings, wherein.

DETAILED DESCRIPTION OF THE INVENTION

Figure 1:
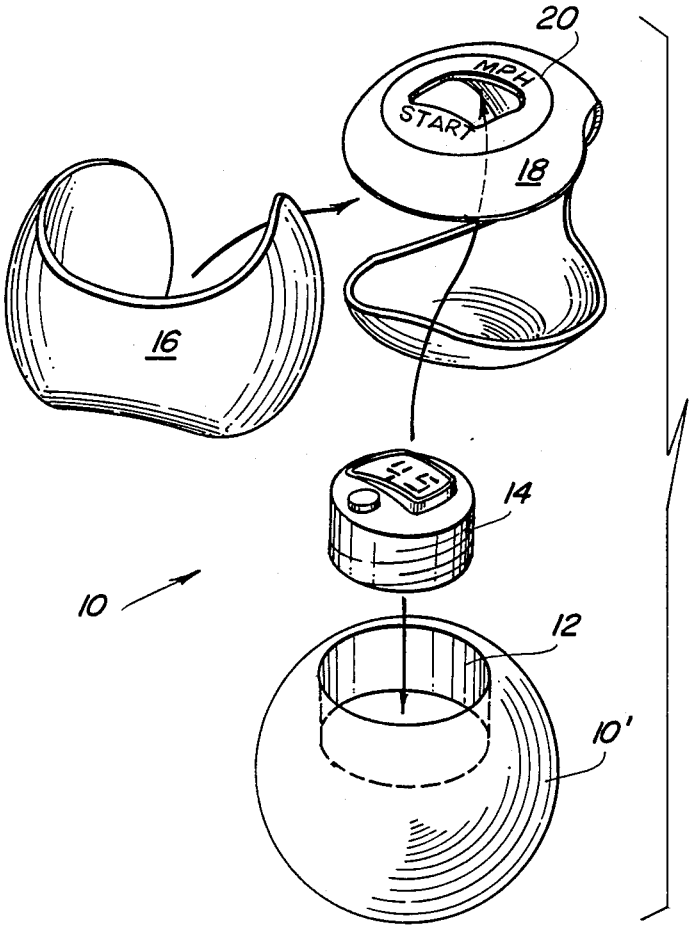
FIG. 1 is a perspective view showing the parts of the baseball of the present invention, including the inner core and the speed-measuring unit for emplacement in the hollow interior of the core.

Referring now to the drawings in greater detail, FIG. 1 shows a baseball 10 incorporating therein the speed-measuring unit of the present invention. Baseball 10 is preferably made of a central core 10' of compressed cork in which is formed an inwardly radial, hollowed-out portion 12, in which is placed the unitary, holistic speed-measuring unit 14 of the present invention. The hollowed-out portion 12 has a first, open end substantially coplanar with the curved outer-circumferential surface of the core 10', and a second, closed-off end positioned substantially radially of the open end, so that the unit 14 extends substantially radially inwardly. Baseball 10 is also provided with an outer covering or shell of molded vinly, preferably made in two parts 16 and 18, which completely surround the inner core 10' and are stitched or sewn together by any conventional means. The outer section 18 is also provided with a circular cutout 20 which receives a transparent plastic casing, through which may be viewed the liquid crystal display (LCD) of the unit 14, so that the speed of the ball thrown may be readily guaged thereby.

Figure 2:
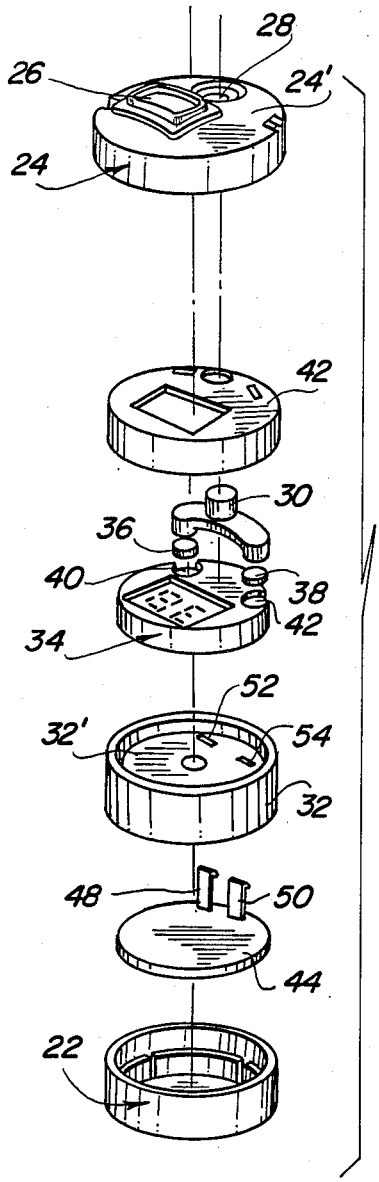
FIG. 2 is an assembly view showing the parts of the speed-measuring unit, which incorporates a single, enclosed housing mounting all the parts thereof.

Referring to FIG. 2, the speed-measuring unit or module 14 is shown in greater detail. The unit 14 is housed within a separate, unitary housing, which includes a lower rear casing 22, which abuts against the closed end of the hollowed-out portion 12, and an upper, transparent casing 24 having a separate window-portion 26 provided therein for viewing the liquid crystal display, casing 24 being received in the cutout 20 of the outer shell-portion 18. The upper casing 24 also includes a through-opening 28 through which projects a start button 30 to be described in greater detail below. The upper casing 24 is also preferably formed with a convex-shaped upper surface 24' in order to be contoured similarly to the curved, outer-circumferential surface of the baseball. Also, preferably, the window 26 is similarly shaped.

The entire speed-measuring module 14 is a one-piece, holistic unit, which provides for durable operation, greater shock absorption, considerably reduced manufacturing costs and ease of manufacture. The module 14 has a parts-mounting frame 32 on the upper surface 32' of which is mounted a hybrid printed circuit board combined with LCD unit 34, which board incorporates the custom clip of the present invention as described below in greater detail. The unit 34 is received in the upper surface of the frame 32 via the recessed circular opening thereof. The unit 34 also mounts the start button 30 and pads 36 and 38 therefor, which pads 36 and 38 are received in circular recesses 40 and 42 of the board 34. The board 34 is closed-off by the LCD casing 42. On the lower surface of frame 32 is mounted the piezoelectric plate or switch 44, which is used in conjunction with the electrical circuitry of FIG. 7 to stop the countdown of the speed-measuring module 14 when the baseball is caught. The plate 44 is connected to the hybrid board 34 by a pair of springs 48 and 50, which springs extend through suitably-shaped through-holes 52 and 54 formed in the body of the frame 32. The piezoelectric plate 44 is received in the lower circular recess on the bottom of the frame 32, and held in place by the lower or rear casing 22. Preferably, frame 32, rear or lower casing 22, and the upper or front casing 24 are made of hard plastic such as polypropylene. The piezoelectric plate 44 may be made of any conventional piezoelectric material, such as a well-known dielectric quartz or the like.

In order to aid in the shock-absorption capabilities of the unit 14, padding is provided between the upper face of the piezoelectric plate 44 and the lower surface of the bottom portion of the frame 32, with the springs 48 and 50 extending through the padding. Padding is also employed above the hybrid board 34, as well as other places between the parts of the present invention, in order to help in the absorption of shock and undue forces caused by catching the ball.

The connections between the hybrid board and the piezoelectric unit 44, as described above, are the springs 48 and 50. Owing to the excessive forces exerted when the ball is caught, large concentrations of forces are directed along the springs 48 and 50. Toward this end, the ends of the springs 48 and 50 are not soldered at their connection points with the board and piezoelectric plate. This allows for the increase of shock absorption of the unit 14, while still ensuring that proper contacts are achieved. The through-holes 52 and 54 ensure that the springs 48 and 50 are held in their normal positioning, while the natural bias of the springs ensures that proper contact is realized, both at the upper ends thereof, and their contact with the output pads of the hybrid board 34, as well as with the lower ends thereof at their contact with the upper surface of the piezoelectric plate 44.

Figure 3A:
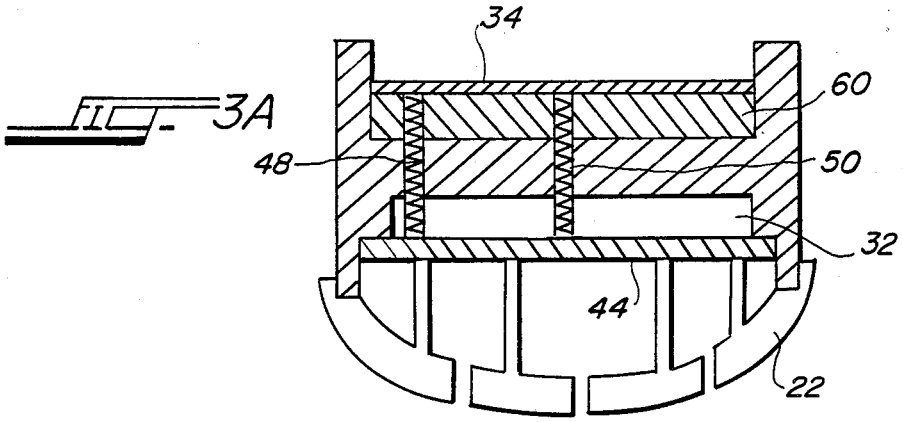
FIG. 3A is a detailed cross-sectional view showing the piezoelectric switch plate connected to the hybrid board of the speed-measuring unit via a pair of springs.
Figure 3B:
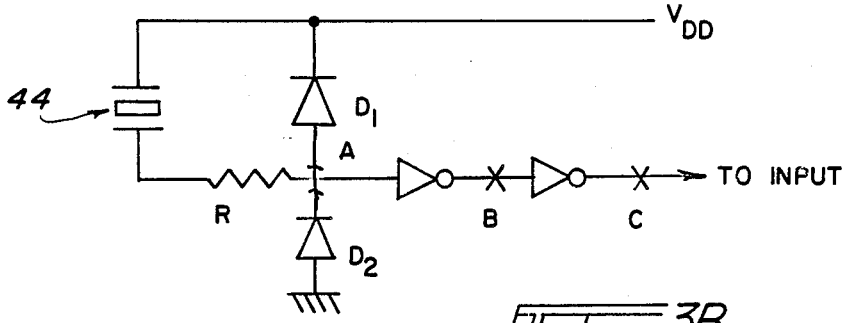
FIG. 3B is an electrical schematic showing the circuitry for connecting the piezoelectric switch plate between the constant voltage power source and the pad input of the hybrid printed circuit board.
Figure 3C:
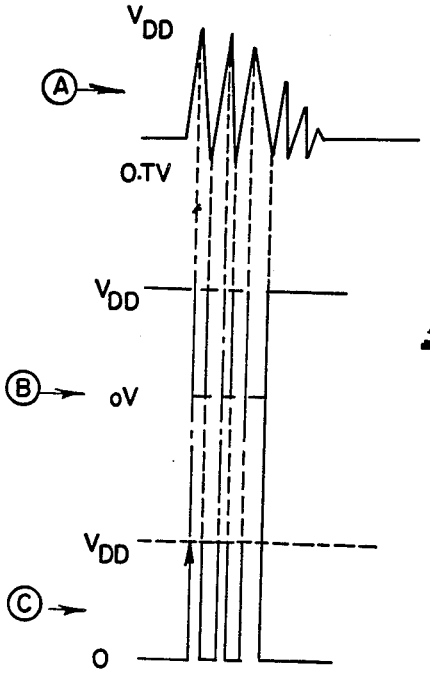
FIG. 3C is a graph of the voltages at points A, B, and C of FIG. 3B.

FIG. 3A shows a preferred embodiment of the connection of the springs 48 and 50 with the hybrid board 34 and piezoelectric plate 44. As shown, a layer of padding made of rubber or other suitable material 60 is provided on the undersurface of the hybrid board for resting upon the upper surface 32' of the frame 32. Suitable openings are formed in the padding 60 to allow for passage of the springs. The piezoelectric plate 44, which provides the stop input into the circuitry of the chip of the present invention, is mounted in series with a constant voltage source indicated in FIG. 3B by the voltage Vdd, which may be, for example, between 2.5 and 3.5 volts. In the well-known manner, when the piezoelectric plate is caused to vibrate or to be distorted, the normally-open circuit shown in FIG. 3B becomes closed to allow for connection of the constant voltage Vdd to the stop input of the hybrid board, to thereby disable the circuitry of FIG. 7 in the manner to be described below in greater detail. The constant voltage source Vdd is preferably provided by a pair of batteries mounted on the undersurface of the frame 32, with appropriate connections provided through the frame 32 for the connection of the constant voltage source to the appropriate input pads of the hybrid board 34. As FIG. 3B shows, the piezoelectric plate 44 is connected in series with the positive power source Vdd, with a pair of inverters inverting the signals, inverting the voltages at "A" and "B" so as to provide a step function at "C," the first leading edge of which causes the data to be latched in a manner to be described below. FIG. 3C shows the value of the voltage at "A" in FIG. 3B, as compared with the voltages at points "B" and "C" thereof. The cyclical voltage at "A" is caused by the vibration of the piezoelectric plate 44 upon catching the ball.

Figure 4:
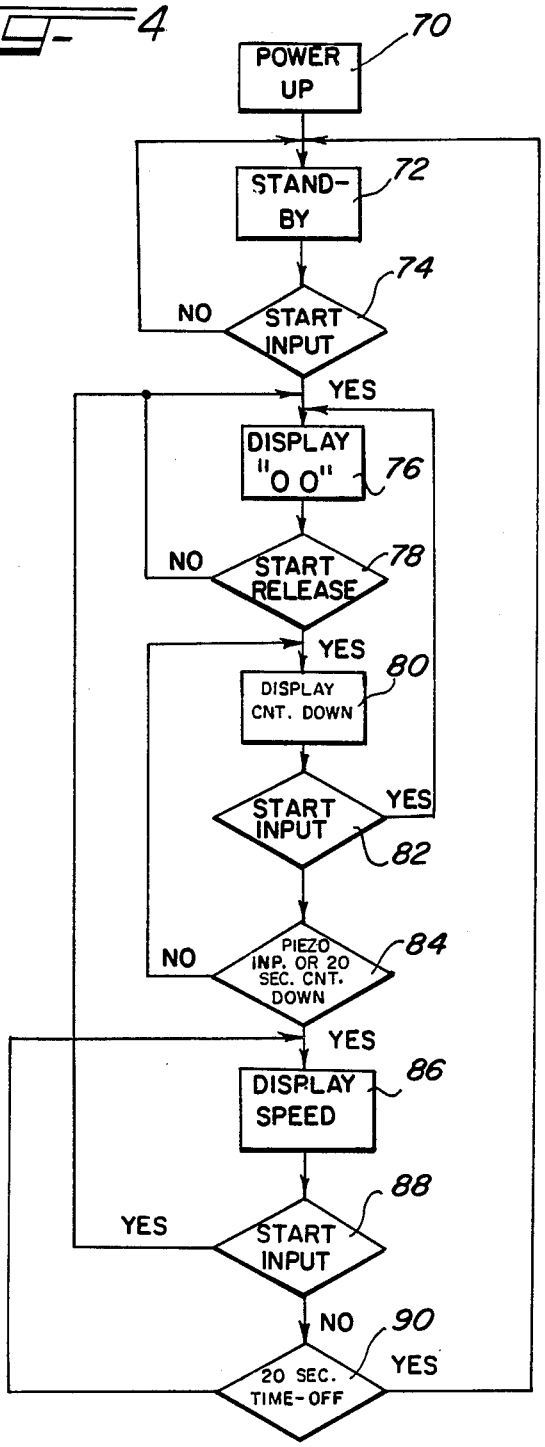
FIG. 4 is a flow chart showing the sequence of events of the speed-measuring unit of the present invention.
Figure 5:
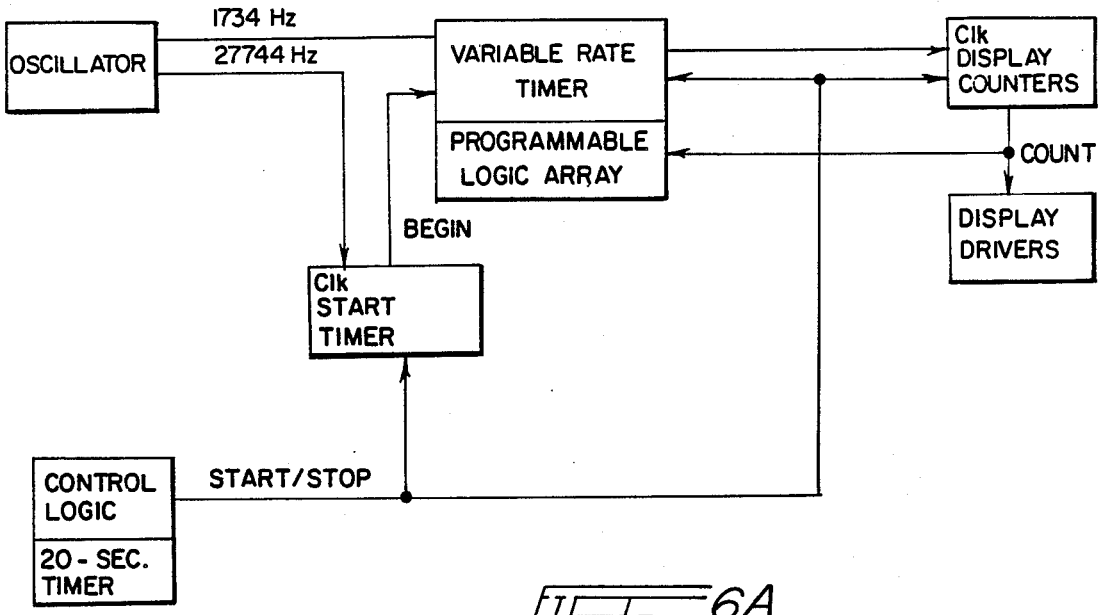
FIG. 5 is a block diagram of the speed-measuring circuitry of the present invention.

FIG. 4 is a flow chart of the sequence of events of the unit or module 14. As indicated by block 70, power-up readies the entire device for a standby condition, as indicated by block 72. With the pitcher depressing start button 30, as indicated by block 74, the display unit is initialized, as indicated by block 76; whereupon the release of the start button, indicated by block 78, initializes the countdown, as indicated by block 80. As long as there is no "end" signal provided to the module 14, the countdown will continue, as indicated by block 82. When the baseball is caught, the piezoelectric switch causes an end-signal input to the module 14, indicated by block 84, which latches the data and causes display of the actual speed as determined by the module 14, as shown in block 86. As indicated by block 88, again pressing the start button 30 initializes the entire unit for repeated use. Block 90 indicates the twenty-second timer, which is included in the circuitry of the chip of the present invention, and causes the unit to shut off after twenty seconds have elapsed from release of the start button, indicated by block 78.

Figure 6A:
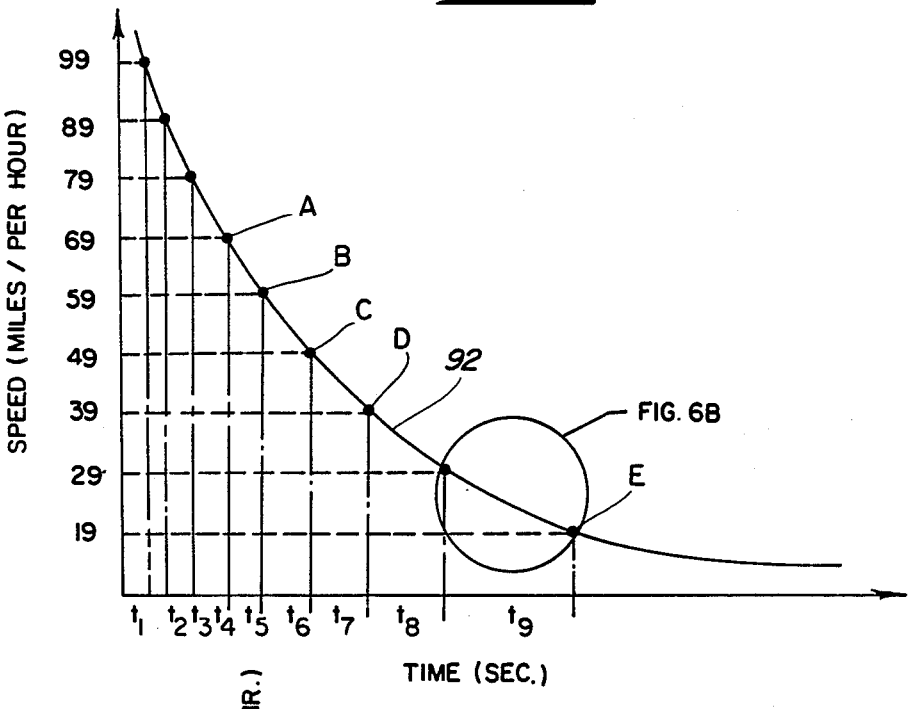
FIG. 6A is graph of speed vs. time of a ball thrown over a fixed distance, showing nine time intervals used in the calculations of the speed for the speed-measuring unit of the present invention.
Figure 6B:
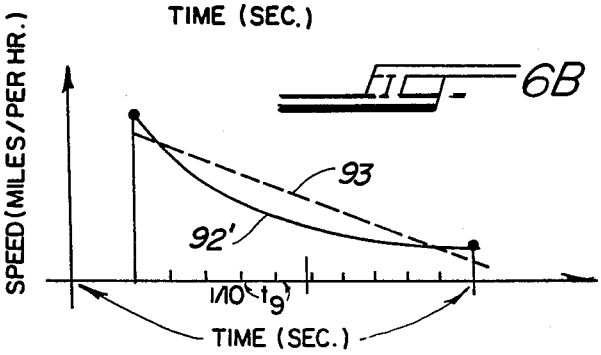
FIG. 6B is a graph of an enlarged section of the graph shown in FIG. 6A, showing a linear approximation of a time interval via points between the limits thereof.

Referring to FIGS. 6A and 6B, the underlying concept by which the speed of the ball is to be determined is shown. FIG. 6A is a graph showing speed vs. time for a fixed distance, such as 60 feet, 6 inches—the distance from a pitcher's mound to home plate. The ordinate indicates time and the abcissa indicates speed. As can be seen, the curve is an hyperbola in accordance with the equation of speed =distance/time. As shown in FIG. 6A, there are indicated speeds from 99 miles per hours to 19 miles per hour, in ten miles per hour decrements, along the abcissa. On the ordinate, nine time intervals of t1 through t9 are indicated. The sequential addition of time intervals is indicative of the speeds shown in FIG. 6A; for example, the speed of 59 miles per hour corresponds to the time of t1+t2+t3+t4+t5. Thus, there are nine "real" points defined along the curve of FIG. 6. Therefore, the electrical circuitry of the module 14, as will be described below in greater detail, uses each of these time intervals in order to determine the rate at which the programmable timer of the electrical circuitry of the invention counts down. The points on the graph between the "real" points shown, which correspond to the time intervals above-indicated according to the present invention, are estimated in the manner shown in FIG. 6B, Such estimation, for example, is achieved by a first-order linear approach, with the portion 92' of the curve 92 being shown by a solid line, and the approximation thereof being shown by a dotted straight line 93, which is divided into ten equal segments for use in estimating the true curve 92'. Thus, for that portion of the curve indicated by 92' in FIG. 6B, the variable rate timer of the instant invention will count down at the same rate ten times in order to decrement the display counter of the LCD unit by 1/10th. The rate of countdown of the programmable counter is adjusted according to which arcuate segment, such as 92', is being estimated along the entire curve 92. Thus, at the point labeled "A" along the curve 92 in FIG. 6A, the programmable counter will countdown ten times at a fixed rate until point "B" is reached. At that time, the programmable counter is reloaded in order to count down at a new, slower rate, which corresponds to the segment of the curve 92 between points "B" and "C," with each countdown occurring ten times until point "C" is reached, when a new reloading of the variable programmable counter is initiated, and a new countdown rate established, until point "D" is reached. This is so because each of the time intervals t1 through t9 increases in length, as is clearly evident from FIG. 6A. According to FIG. 6B, the linear approximation only approximates that segment of the curve 92 between the fixed "true" points provided in a suitable table embodied by a programmable logic array of the electrical circuitry of the present invention. The estimated points along the straight line 93, although serving as an approximation, are limited to their mean standard error because of the number of time intervals t1 through t9 chosen. This approach to measuring the speed of the thrown ball allows for electrical circuitry that is accurate to perform as intended, and obviates the need of a microprocessor. While a total of nine time intervals have been indicated, it is clear that more or less than nine may be chosen, depending upon the accuracy desired. The first-order linear approximation of the real curve shown in FIG. 6B is achieved by well-known methods that fit the straight line 93 to the curve, with the minimum mean standard error.

Figure 7A:
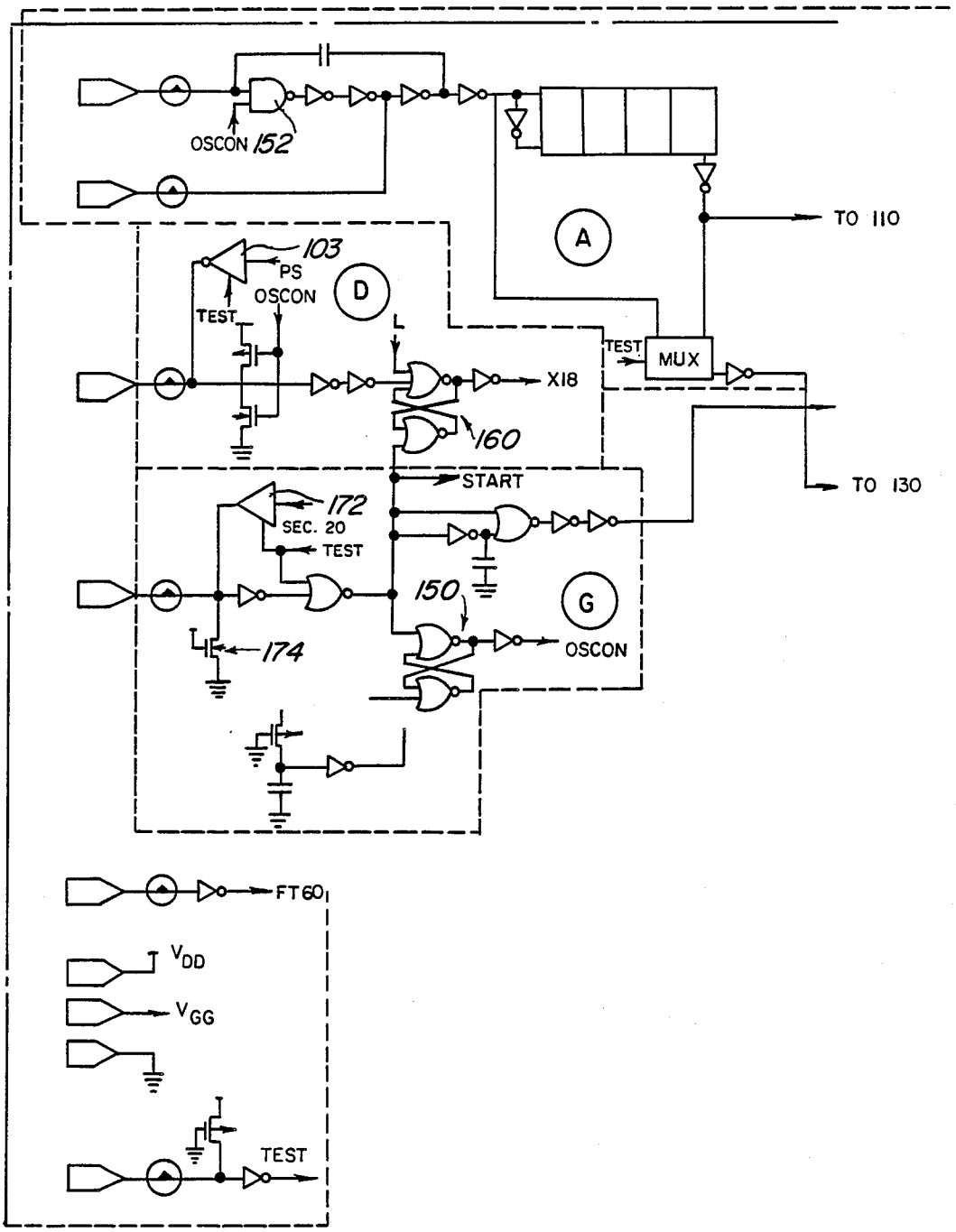
FIGS. 7A and 7B are an electrical schematic of the speed-measuring circuitry of the invention.
Figure 7B:
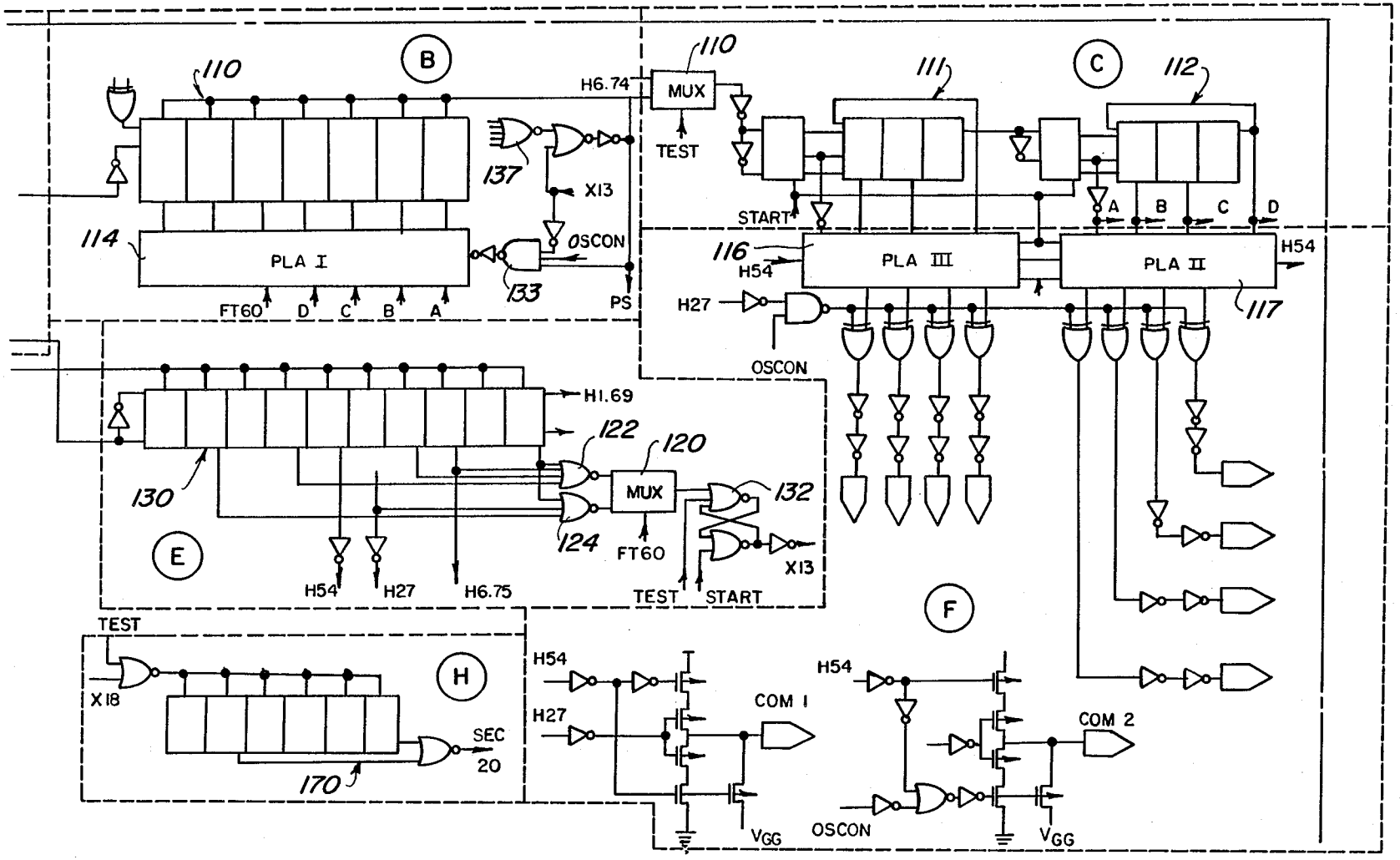

Referring now to FIGS. 7A and 7B, the circuitry for accomplishing the above is shown in detail, and is included in one custom chip. The chip includes, of course, an oscillator section indicated by block "A" in FIG. 7A. The oscillator operates at a frequency of 27744 Hz, which is divided down by sixteen to 1734 Hz for use in sections "B" and "C," to be described below in greater detail. The oscillator provides a time base for all of the other blocks. Briefly summarizing the other blocks, section "B" (FIG. 7B) is the variable rate timer or programmable counter; block "C" (FIG. 7B) includes the display counters for the LCD; section "D" (FIG. 7A) is the piezoelectric switch stop-input signal to stop the modules and indicate the speed; section "E" (FIG. 7B) is the delay countdown section, which delays the enabling of section "B"; section "F" (FIG. 7B) is the LCD control circuitry; section "G" is the starting circuitry for initializing and resetting the other blocks; and section "H" (FIG. 7B) is the 20-second delay timing circuitry for ensuring the unit is shut down after that length of time.

The oscillator section "A" provides the clock signals to the variable rate timer or variable programmable counter, indicated by reference numeral 110, at a frequency of 1734 Hz. The programmable counter 110 operates in a countdown mode, and each time it counts down to zero it is reloaded with a value determinate of the current state of the display counter, indicated by reference numeral 112 in block "C." The display counter 112 represents the most significant digit. The programmable logic array (PLA), indicated by reference numeral 114 in block "B," translates the value of the display counter 112 to a load value for the programmable counter 110. "PS" is a preset signal activated when the programmable counter 110 reaches zero so that it can be reloaded. The PLA 114 will reload the variable counter 110 at each point indicated on the graph of Figure 6A which, in the preferred embodiment, is a total of eight times starting with an effective speed of 99 miles per hour and ending with an effective speed of 20 miles per hour. The reloading by the PLA 114 causes the programmable counter 110 to count down at a different rate, which is longer than the previous rate, in accordance with the shape of the curve 92 in FIG. 6A. The output from block "B" is fed into section "C," by multiplexer 110', to clock the display counters 111 and 112, the outputs of these counters being inputted to the LCD via programmable logic arrays 116 and 117 in section "F." Since the PLA 114 must be properly programmed for the distance over which the ball is thrown, whether such distance corresponds to a Major League baseball field's measurements of 60 feet, 6 inches or the 46-foot distance between the pitcher's mound and home plate in a Little League field, it is accomplished via the set signal FT 60 of block "E."

Section "E" is the time-delay circuitry which includes a ten-stage timer 130. The timer 130 allows for a preset time period to elapse before the programmable counter 110 starts the countdown. The time delay is 411 milliseconds for a 60 foot, 6 inch distance and 315 milliseconds for a 46 foot distance, and is respectively accomplished via NOR gates 122 and 124, both outputs being entered into multiplexer 120. Thus, for this initial time delay, the LCD will indicate a speed of 99 miles per hour, which is representative of the time period t1, shown in FIG. 6A. The setting of multiplexer 120 is achieved via input FT60 for setting the distance to be used. The set/reset output of multiplexer 120 is entered into NOR gate 132 of a flip-flop, which generates signal X13, which is entered into PLA 114 via NAND gate 133 for enabling PLA 114, which output from multiplexer 120 is the reset, while the "start" input is the "set." Upon the enabling of PLA 114, the programmable counter 110 starts its initial countdown at a rate loaded into it by the programmable logical array 114 for the time interval indicated by t2 of FIG. 6A. Upon the enabling of PLA 114, the counter 110 will count down at the rate representative of 1/10th of the time interval of t2, and upon counting down will decrement display counters 111 and 112. After the counter 110 has counted down ten times, with the appropriate value stored in the display counters 111 and 112, and when the values thereof representative of a speed of 89 miles per hour are reached, the outputs A, B, C and D of display counter 112, which is the most-significant digit counter, are entered into the PLA 114, which will cause the reloading into the counter 110 by the PLA 114 of a new value, therefore causing the counter 110 to count down at a new, longer rate representative of the time interval t3 of FIG. 6A. The inputs A, B, C and D of the PLA 114 are combined into a total of eight possible states, each of which is representative of the time intervals t2 through t9, to thereby load the particular load value into the programmable counter 110. Each time the counter 110 counts down, the preset countdown signal "PS" is activated, thereby decrementing the display counters 111 and 112. The variable rate timer 110 is disabled upon receipt of signal X18 from section "D," which is generated by the piezoelectric switch to thereby freeze the display counters. The piezoelectric signal input X18 is synchronized by signal "PS" of section "B" through inverter 103. The signal input X18 will also be activated when the signal from section "F" asserts a signal "L," which occurs when a very slow pitch—too slow to be measured—is generated. NAND gate 133 allows for the enabling of PLA 114 upon an input signal from either the presetting of counter 110 or the signal X13 from the delay timer 130.

The section indicated by block "H" is a 20-second timer, which automatically shuts down the system after twenty seconds have elapsed. Section "G" is the starting circuitry and is initiated by depressing start button 30, which causes the resetting of the counters and asserts OSCON via flip-flop 150. START is held asserted as long as the pitcher holds the start button, preventing X13 of the timer from activating. Upon release of the start button, a short pulse is sent to the reset inputs of the timer 130 to re-initialize it. START is then disasserted and timer 130 counts down. Block "D" is the stop-input circuitry, which is generated by catching the ball, which is sensed by the piezoelectric plate 44, which generates the end signal X18 previously described for latching the data. The signal PS (preset) from the programmable counter 110 is entered into block "D" to synchronize the piezoelectric input. The signal X18, as stated above, will also be activated upon the signal "L" from block "F," which is asserted when a very slow pitch—too slow to measure—is thrown.

In operation, a pitcher will hold the baseball in his hand with one of his fingers placed on the start button 30, thereby depressing the start button 30 to reset the counters. Upon pitching the ball and releasing his hand from the ball, the start button 30 is released and START is disasserted. The oscillator generates the usable frequency of the 27744 Hz, which is divided to the usable frequency of 1734 Hz, which is used by the delay timer 130. In the 60'-6" mode, the delay timer 130 delays the output of signal X13 for 411 milliseconds, during which time the LCD will indicate 99 miles per hour. If the ball is caught before that time, no countdown will have occurred, and the LCD will be frozen at 99 miles per hour by catching the ball and activating signal X18 via the piezoelectric plate. After 411 milliseconds have passed, signal X13 will enable the PLA 114, thereby causing the programmable counter 110 to count down 1/10th of the time interval indicated by t2 in the graph of FIG. 6B. If the ball is caught at any time during the time interval t2, the piezoelectric plate will disable the programmable counter 110 and free the LCD at the value between 79 and 89 miles per hour. The programmable counter 110 will count down a total of ten times during the time interval t2, decrementing the display counters 111 and 112 during each of the ten countdowns. For a ball thrown slower than 79 miles per hour, the PLA 114 will cause the programmable timer 110 to count down at a different and longer time interval, equal to 1/10th of the time interval indicated by t3 in the graph. During each of the countdowns, the display counters are decremented in the same manner as described above. For each of the time intervals t4 through t9, the programmable counter 110 will count down for a longer period of time as measured by 1/10th of the respective time interval, thereby decrementing the display counters and LCD. During any one of these time intervals, if the ball is caught and signal X18 is generated by the piezoelectric plate, the LCD is frozen, with the data latched thereby via the signal X18, with the concomitant disabling of the programmable counter 110 thereby. If the pitch is slower than the time indicated at the end of t9 in the graph of FIG. 6A—which is slower than 20 miles per hour—the LCD will indicate the letter "L" indicating the ball was thrown too slow and is not worthy of being measured. Upon indication of the letter "L" on the LCD, such signal in entered into the flip-flop 160 of Block D, which is the end-signal circuitry, to thereby cause the generation of the signal X18 to thereby latch the data as described above. During each of the countdowns of the programmable counter 110 for the respective time interval with which it is associated, after the programmable counter 110 is counted down a total of ten times, the PLA 114 will cause the generation of a different countdown rate, as determined by the value in the most-significant digit counter 112, as indicated by the outputs A, B, C and D on the display counter 112. After a total lapse of twenty seconds, the timer 170 will shut off the entire device by the signal SEC20 being entered into inverter 172, the output of which is connected to the drain of MOSFET transistor 174, which is a pull-down transistor, thereby ending the OSCON signal. It is noted that in the 46-foot mode, the delay timer 130 will delay the enablement of the PLA 114 for a total of 315 milliseconds. It is also noted that other signals are outputted from the starter delay timer 130, namely H54 and H27, which are used in Block F to generate the timing signal required to drive the LCDs, and also signal H6.75, which is fed to Block C during the test mode, which test mode is used to test the device to ensure its operability during manufacture. The PLAs 116 and 117 convert the output of the display counters 111 and 112 into an output which can drive the proper segments of the LCD. COM1 and COM2 in Block F are the multiplexing time circuits required by the LCD.

While a specific embodiment of the invention has been shown and described, it is to be understood that numerous changes and modifications may be made without departing from the scope and spirit of the invention as set out in the appended claims.

What is claimed is:

1. A speed-measuring baseball comprising: a solid core having a hollowed-out portion, said hollowed-out portion having a first open end substantially coplanar with the outer circumferential surface of said core, said hollowed-out portion further comprising a second closed end extending radially inwardly toward the center of said core;

a speed-measuring means mounted in said hollowed-out portion of said solid core, said speed-measuring means being a self-contained unit comprising a housing for mounting parts therein, said housing having a lower casing for positioning in said hollowed-out portion adjacent said second closed end thereof, and an upper casing positioned adjacent said first open end;

said speed-measuring means comprising means for determining the speed at which the ball is thrown; and said speed-measuring means further comprising a piezoelectric switch means for generating an end signal upon catching the ball by a catcher, said piezoelectric switch means being coupled to said means for determining the speed and mounted in said housing, and a manually-operated start switch for actuating said speedmeasuring means mounted by said housing.

2. The baseball according to claim 1, wherein said means for determining the speed comprises:

means for segmenting the time of flight of a thrown ball into a plurality of unique time segments;

programmable counter means coupled to said means for segmenting a plurality of time segments, said means for segmenting controlling the rate at which said programmable counter counts down such that the countdown thereof is different for each respective said time segment;

display means for indicating the speed at which the ball is thrown;

said display means being coupled to said means for segmenting so as to control the loading of said programmable counter via said means for segmenting based on the instantaneous reading of said display means;

said end signal from piezoelectrical switch being operative to disable said programmable counter and to freeze said display means when said ball is caught.

3. The baseball according to claim 2, wherein said means for determining the speed further comprises a start means for resetting said delay timing means and said display means, and then for initiating the actuation of said delay timing means after said delay timing means has been reset.

4. The baseball according to claim 2, wherein said means for determining the speed further comprises a delay timing means for delaying the start of operation of said programmable counter means for a specified period of time.

5. The baseball according to claim 4, wherein said delay timing means is operatively coupled to said means for segmenting a plurality of time segments for initiating the operation thereof and the loading thereof of a first set of values into said programmable counter means.

6. The baseball according to claim 4, wherein said means for determining the speed further comprises means for shutting off said means for determining the speed upon the passage of a specified period of time which is indicative of the speed of a thrown ball that is lower than that which is capable of being measured.

7. The baseball according to claim 2, wherein said means for segmenting comprises a programmable logic array operatively coupled to said programmable counter means for loading into said programmable counter means a plurality of different values representative of said time segments, said programmable logic array causing said programmable counter means to count down a different rate for each of said values.

8. The baseball according to claim 7, wherein said display means comprises a most-significant display counter, the inputs of said programmable logic array being directly coupled to the outputs of said most-significant digit display counter of said speed display means; said programmable counter means counting down a total of ten separate times for each of said values of said programmable logic array representative of a respective said time segment, said respective time segment being that which is instantaneously indicated on said most-significant digit display counter of said speed display means.

9. The baseball according to claim 7, wherein said speed display means comprises a liquid crystal display for visually indicating the speed at which the baseball is thrown, said liquid crystal display means being operatively coupled to a least-significant digit display counter, and a most-significant digit display counter, said most-significant display counter being operatively coupled to said programmable logic array for setting the value loaded into said programmable counter from said programmable logic array.

10. A baseball for measuring the speed at which it is thrown, comprising:

a substantially solid core having a hollowed-out area;

an enclosed capsule for mounting in said hollowed-out area of said substantially solid core;

speed-measuring means mounted within said capsule for placement in said hollowed-out area;

said speed-measuring means comprising means for determining the time of flight of the baseball over a fixed distance, means for converting the time into speed thereof, and means for visually displaying the speed; and means for generating a stop signal to said speed-measuring means upon catching the baseball.

11. The baseball according to claim 10, wherein said speed-measuring means comprises a hybrid board upon which is mounted said means for displaying;

said means for displaying comprising a casing having a through-opening, and said speed-measuring means comprising a start button having a portion thereof extending through said through-hole of said display casing;

said capsule having an upper, transparent cover comprising a window portion for viewing said means for displaying.

12. The baseball according to claim 11, further comprising an outer shell about said substantially solid core, said outer shell comprising a first and second portion stitched together about said substantially solid core, one of said first and second portions comprising an opening through which extends said cover of said housing such that said window portion of said cover lies substantially coplanar with the curved plane containing therein the outer circumferential surface of said oouter shell;

said cover of said capsule also comprising a through-opening through which extends a portion of said start button.

13. The baseball according to claim 10, wherein said speed-measuring means comprises a computer chip mounted within said capsule;

said means for generating a stop signal comprising a piezoelectric plate mounted in said capsule and operatively coupled to said computer chip;

spring means for coupling said piezoelectric plate to respective portions of said computer chip, the ends of said spring means being respectively in contact with at least a portion of said piezoelectric plate and at least a portion of said computer chip;

means for mounting said spring means betweeen said piezoelectric plate and said computer chip so as to ensure proper contact of the ends of said spring with said at least one of the portions;

said ends of said spring means being free from soldered connection with said at least one of the portions of said computer chip; and said speed measuring means comprising a constant voltage source, said piezoelectric plate being connected in series with said constant voltage source.

14. The baseball according to claim 13, wherein said capsule further comprises a frame means having an upper surface for mounting said computer on said upper surface, said frame means also having a lower surface for mounting thereto said piezoelectric plate, said means for mounting said spring means comprising at least one through-opening through said frame means from said upper surface to said lower surface, said spring means passing through said at least one opening.

15. The baseball according to claim 14, wherein said capsule further comprises shock absorbing pad means mounted above said upper surface for absorbing shocks and excessive forces caused by catching the baseball.

16. A method of determining and displaying the speed at which a baseball is thrown over a fixed distance, which baseball has a specific time of flight associated therewith over the fixed distance, comprising:

(a) dividing the time of flight into a plurality of unequal time segments;

(b) dividing each of said unequal time segments into a plurality of time segments;

(c) said step (b) being an approximation of a portion of a curve of speed vs. time of the baseball thrown along a fixed distance;

(d) generating electronic signals corresponding to the time segments of said step (b);

(e) interpreting the signals from said step (d) into an indication of the speed of the baseball;

(f) indicating the speed derived from said step (e); and (g) said step (f) comprising continually decrementing the value indicated in said (f) until the baseball is caught.

17. The method according to claim 16, wherein said step (c) comprises approximating a portion of a curve by a first-order linear approximation.

18. The method according to claim 16, wherein said step (a) comprises dividing the time of flight into a total of nine unequal time segments; and said step (b) comprises dividing each said time segment into ten equal segments.

19. The method according to claim 18, wherein each of said unequal time segments is different from every other of said unequal time segments, said time segments increasing in length from one to the next.

20. The method according to claim 19, wherein said step (d) comprises generating signals from a programmable counter, said step (d) comprising counting down the programmable counter a plurality of times for each of the time segments of said step (a), said plurality of times being equal in number to the plurality of time segments of said step (b).

21. A speed-determination unit for measuring the speed at which an object travels, comprising;

means for dividing time of flight of an object over a fixed distance into a plurality of unequal time segments;

means for dividing each of said unequal time segments into a plurality of equal time intervals; said means for dividing comprising means for generating electrical signals representative of said equal time intervals; and means coupled to said means for generating electrical signals for converting the electrical signals to an indication of the speed of the object.

22. The speed-determination unit according to claim 21, wherein said means for dividing the time of flight of the object comprises timing means for generating a first said time interval, said first time interval originating at the initial motion of the object, and programmable means operatively coupled to said timing means and to the output of said means for converting electrical signals.

23. The speed-determination unit according to claim 22, wherein said means for dividing each said unequal time interval comprises a variable programmable counter coupled to said programmable means; said means for converting electrical signals comprising display counter means which are decremented via said variable programmable counter

* * * * *